United States Patent [19]

Krusche et al.

[11] 4,023,336

[45] May 17, 1977

[54] YARN RESERVE FORMING AND MOVING APPARATUS

[75] Inventors: Peter Krusche, Bremen; Dieter Twillmann, Bremen-Farge, both of Germany

[73] Assignee: Fried. Krupp Gesellschaft mit beschrankter Haftung, Essen, Germany

[22] Filed: June 4, 1975

[21] Appl. No.: 583,765

[30] Foreign Application Priority Data

June 26, 1974 Germany ..... 2430544

[52] U.S. Cl. ..... 57/34 R; 57/58.89

[51] Int. Cl.[2] ..... D01H 1/12

[58] Field of Search ..... 57/34 R, 58.89, 58.95, 57/106

[56] References Cited

UNITED STATES PATENTS

| | | | |
|---|---|---|---|
| 2,491,569 | 12/1949 | Lichtenberg | 57/34 R |
| 3,455,095 | 7/1969 | Makeham et al. | 57/58.89 X |
| 3,492,804 | 2/1970 | Landwehrkamp et al. | 57/58.89 |
| 3,680,300 | 8/1972 | Landwehrkamp | 57/58.95 X |
| 3,760,576 | 9/1973 | Le Chatalier et al. | 57/58.89 X |
| 3,803,823 | 4/1974 | Niestroj et al. | 57/58.95 X |
| 3,821,878 | 7/1974 | Parsons | 57/58.95 X |

FOREIGN PATENTS OR APPLICATIONS

| | | |
|---|---|---|
| 82,078 | 3/1971 | Germany |

*Primary Examiner*—Richard C. Queisser
*Assistant Examiner*—Charles Gorenstein
*Attorney, Agent, or Firm*—Spencer & Kaye

[57] ABSTRACT

Apparatus for forming a yarn reserve and for moving yarn back and forth in open-end spinning devices. This type of device has at least one spinning turbine, a yarn delivery opening, and a pair of delivery rollers opposite the opening. A yarn guide rod has guide elements and is located downstream of the delivery opening in the direction of yarn movement. The yarn guide rod is displaceable in a direction transverse to the axis between the opening and the delivery rollers. This rod defines a deflection device for diverting the yarn from the axis. A drive is provided for driving the yarn guide rod and is in interruptable connection therewith. The drive moves the guide rod back and forth and moves the guide rod to a further position for providing a yarn reserve.

15 Claims, 7 Drawing Figures

YARN RESERVE FORMING AND MOVING APPARATUS

BACKGROUND OF THE INVENTION

The present invention relates to apparatus for forming and moving a yarn reserve in an open-end spinning machine.

Apparatus of the type to which the invention is directed include a spinning turbine or a plurality of parallel-connected spinning turbines and yarn exit openings which are provided with oppositely arranged pairs of delivery rollers. The exit openings are connected in series with a yarn guide rod provided with guide elements and displaceable in a direction transverse to the axis defined by the exit opening and its associated delivery roller pair, the rod forming a deflection device which carries along the yarn coming out of the exit opening.

Spinning turbine machines require an apparatus for forming a yarn reserve because the machine can be restarted only if a yarn reserve can be refed into the spinning turbine within fractions of seconds in order to be connected in the fiber collection trough of the spinning turbine to the ring of fibers formed of fibers just previously fed thereinto.

It is furthermore the custom to displace the yarn coming from the exit opening of the spinning turbine from side to side by a few millimeters. This back-and-forth movement of the yarn prevents the formation of tracks, or grooves in the rubber coating of the pressure roller of the associated pair of discharge rollers.

East German Pat. No. 82,078 describes an apparatus for open-end spinning machines for returning the yarn end into the spinning member during restarting of spinning in which the finished yarn is removed by means of delivery rollers and is wound on a spool. The spinning chamber is followed by a stationary yarn guide, while a further stationary yarn guide is provided in front of the spool. A movable yarn guide is disposed in the region of the delivery rollers between the spinning chamber and the discharge rollers and this yarn guide is movable in the axial direction of the delivery rollers and is provided with a slit as the guide element.

The yarn guide is provided, in addition to the drive for forming and releasing the yarn reserve loop, with a second drive for a back-and-forth movement of the yarn between and transversely of the delivery rollers, both drives being elastically coupled together. While the back-and-forth movement is produced by a motor and a rope pulley disposed on a crank, the reserve force required for the formation of the yarn reserve loop is effected by a magnet.

The drawback of this known apparatus is that the reserve force for the yarn guide is produced by magnets which suddenly move the pulling means which is in connection with the yarn guide. However, the formation of the yarn reserve loop must be effected very slowly since otherwise the yarn could be pulled out of the spinning turbine and may break.

SUMMARY OF THE INVENTION

It is an object of the present invention to provide an apparatus for forming a yarn reserve and for moving the yarn transversely back and forth.

Another object is to provide such apparatus which is as inexpensive as possible.

A further object is to provide such apparatus which permits the dependable formation of a yarn reserve.

These objects are accomplished by providing a yarn guide rod connected with a drive device which is moved only in one direction of rotation and which can be switched off. This drive means produces the back-and-forth movement stroke as well as the reverse stroke required to form the yarn reserve.

In a preferred embodiment of the present invention the yarn guide rod is connected with a gear assembly, via the intermediary of a damping device. The gear assembly is movable by means of a stepping mechanism to deflect the yarn—against the force of a resetting device connected with the yarn guide rod—and by releasing a coupling, or clutch, disposed ahead of the stepping mechanism it can be moved to reduce the degree of deflection. The stepping mechanism and the displacement device for the coupling are switched on by means of switching units when a predetermined position of the yarn guide rod with respect to the axis of the exit opening and the pair of delivery rollers has been attained so that the stepping mechanism is actuated or the coupling is released, respectively.

In a further embodiment of the present invention, the yarn guide rod is connected—when seen from the drive side—via a toothed rod, with a pair of reduction gears of which the pinion is part of the clutch.

The stepping mechanism preferably includes a pawl which engages in the teeth of a ratchet wheel and which is displaceable in a direction perpendicular to the axis of rotation of the ratchet wheel via a lever and by means of a spring charged magnet. The ratchet wheel is simultaneously provided with a flyback suppressor which prevents rotation of the ratchet wheel in a direction opposite to the movement of the latch.

Thus the present invention substantially includes a switching mechanism of a certain design with which the back-and-forth movement as well as the reserve movement can be effected. During the spinning process the yarn coming from the spinning turbine is moved back and forth and during the slowing down of the spinning machine the yarn reserve required for restarting the machine is formed.

A further embodiment of the invention provides that the toothed rod connected with the yarn guide rod cooperates with a terminal switch associated with the magnet and with a terminal switch associated with the setting device. The magnet terminal switch is adjustable in position with respect to the control surface of the toothed rod when seen in the direction of the lifting stroke produced by the stepping mechanism. The magnet terminal switch is disposed ahead of the terminal switch for the setting device. The damping device advantageously includes a piston which during the resetting movement of the yarn guide rod supports itself in the region of its final position, i.e. in the region of the deflection-free position of the guide rod on a cushion of air.

The movement of the guide rod during resetting which is rapid in the beginning stage is braked in the final stage by a cushion of air enclosed between the piston and the associated cylinder. The resetting device can be easily realized by a biased spring the longitudinal axis of which is offset by 90° with respect to that of the guide rod. This spring is connected with the guide rod via a guide roller mounted at a fixed point and a flexible tension element. Thus, the guide rod is returned to its starting position by the biased spring as soon as the clutch has been released by the influence of the associated terminal switch so that the yarn coming from the exit opening of the spinning turbine is no longer deflected.

The movable component of the clutch is preferably connected with an electromagnet which releases the yarn reserve—i.e. releases the clutch—when it is suddenly excited by means of a rapid switching device. The time required for this purpose is ⅛ to 1/10 of the usual value.

The moment of switching of the rapid switching device is preferably controlled by a counter with a selectable counting time. The counter is coupled with the switch for switching on the spinning machine. The counter is preferably provided with an electronic pulse counter which is connected in series with a speed, path or time controlled pulse generator. The pulse sequence to be counted may be produced, for example, by a magnetically inductive sensor or by RC members.

In a further embodiment of the present invention the pulling magnet terminal switch is coupled to a blocking switch member for the start of the spinning phase and to a blocking switch member for the switch-off phase. The respective terminal switch—which takes over the unlatching of the back-and-forth stroke—is rendered ineffective by the two electronic switching members during all of the time under discussion.

A further advantageous embodiment of the present invention provides that the electromagnet for the back-and-forth and the reserve strokes is excited during the spinning phase by a pulse generator with a low pulse repetition rate and during the switch-off phase by a pulse generator with a high pulse repetition rate. The electromagnet is consequently excited to operate at different speeds—depending upon which pulse generator is effective.

Advisably a timer with a fixed pulse duration is connected in series to the two available electromagnets—the pulling magnet for the actuation of the movable component of the clutch and the electromagnet for the back-and-forth stroke and for the reserve stroke. The switch-on pulse which drives the magnets is consequently independent of the pulse repetition rate of the associated pulse generator as well as of the switch-on duration of the two terminal switches since the two timers act as electronic limiting stages which also extend shorter pulses to the set pulse duration.

Further significant features and characteristics of the present invention will be explained in detail for the embodiment which is illustrated in the drawing.

DESCRIPTION OF THE PREFERRED EMBODIMENTS

Figure 1A:
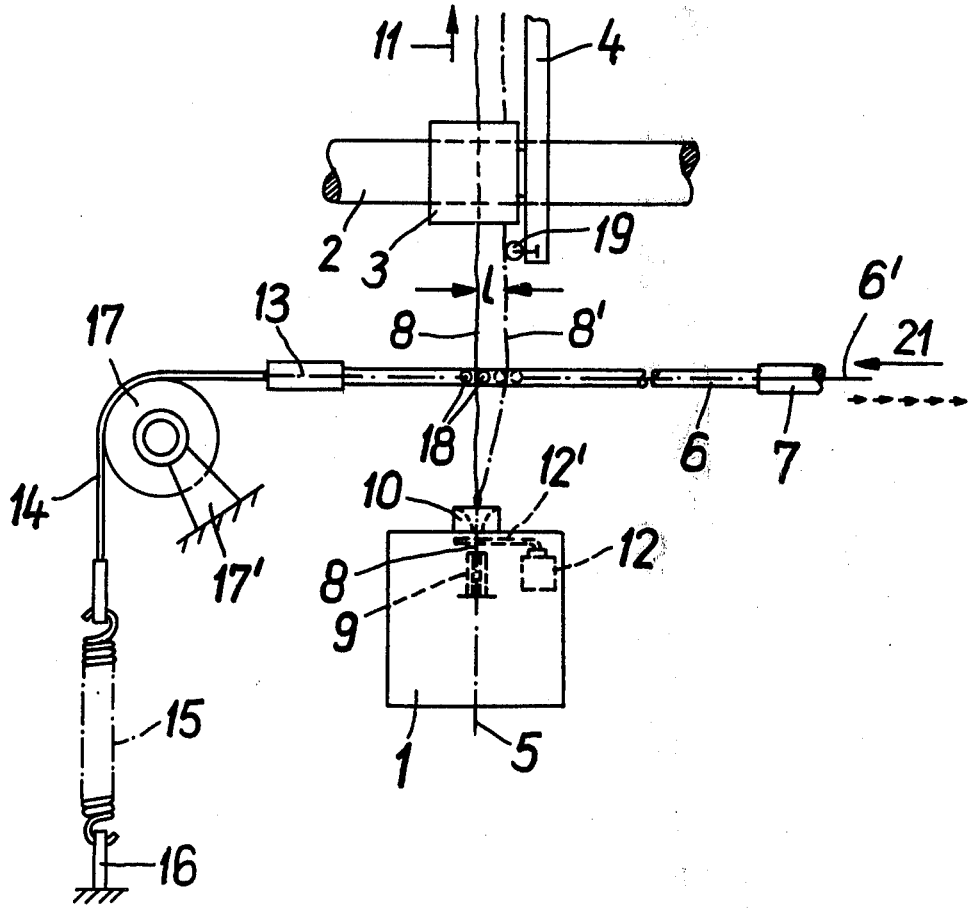
FIGS. 1*a* and 1*b* are diagrammatic views showing the position of the yarn guide rod after a back-and-forth stroke or a reserve stroke has been performed.

Between a housing 1 which accommodates the spinning turbine and the associated feed devices and the pair of delivery rollers, a yarn guide rod 6 and a connecting piece 7 are disposed. The yarn guide rod 6 is displaceable in a direction perpendicular to the connecting axis 5 of parts 1, 2 and 3. The delivery rollers include feed cylinder 2 and pressure roller 3 disposed thereabove. Both rollers are rotatably mounted in a stationary support 4.

The yarn 8 produced in the spinning turbine is discharged in the direction of arrow 11 through guide tube 9 and exit opening 10 by means of the pair of delivery rollers 2, 3. A known yarn sensor device 12 is disposed between guide tube 9 and exit opening 10 and has a sensor 12' in contact with yarn 8. The yarn sensor device 12 which is schematically illustrated is actuated as soon as the tension of yarn 8 drops due to a break in the yarn in the spinning turbine.

The yarn guide rod 6 is connected at its end opposite the connector 7 with a pretensioned tension spring 15 via a further connector 13 and a tensioning element 14. The lower end of the tension spring 15 is held stationary by the sleeve 16. The longitudinal axis of spring 15 is offset by 90° with respect to the longitudinal axis 6' of the guide rod 6. The force exerted by the spring has its direction changed by means of a guide roller 17 which is supported on a stationary support 17'.

The yarn guide rod 6 is made particularly lightweight in order to reduce its inertia. For example, it can be made of aluminum pipe, a thick aluminum wire or of steel wire. The yarn guide rod 6 is provided with two spaced juxtaposed pins 18 which carry along the yarn 8 passing therebetween and thus deflect it.

The length of path 1 corresponds to the back-and-forth stroke of the yarn guide rod 6 (FIG. 1*a*). The yarn takes the position 8' shown in dash-dot lines in which it is supported at a stationary support roller 19 which precedes the pair of delivery rollers 2, 3. Instead of the supporting roller some other deflecting means can likewise be used.

Figure 1B:
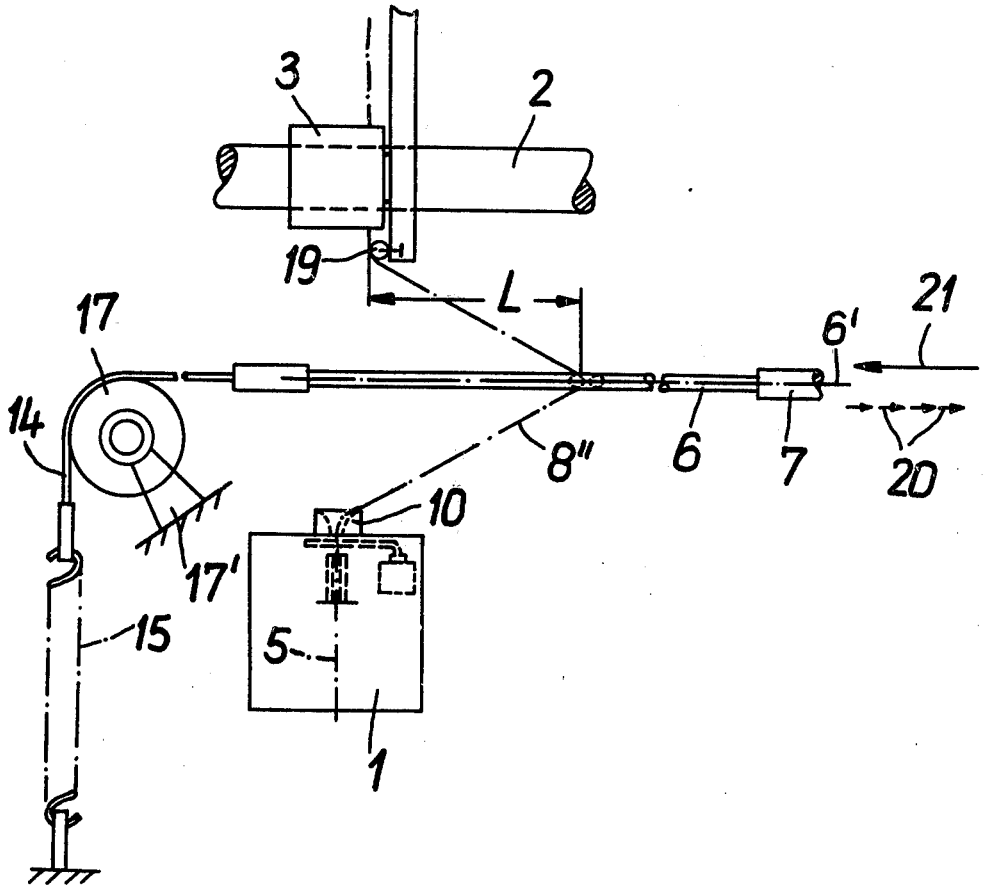

After formation of the yarn reserve loop, the yarn guide rod 6 moves toward the right by a further distance L (FIG. 1*b*) compared to the position shown in FIG. 1*a*. The yarn discharged through exit opening 10 then takes up the position 8'' which is shown in dashed lines in FIG. 1*b* and in which it forms a partial loop around stationary supporting roller 19. The length of spring 15 has thus been extended to a degree which corresponds to the path traversed by the guide rod (FIG. 1*b*). The direction of movement of the guide rod 6 during the back-and-forth stroke and during the reserve stroke is shown by arrows 20. The reset movement of guide rod 6 produced by the tension of spring 15 in the direction toward its starting position shown in FIG. 1*a* (position 8 of the yarn) is shown by arrow 21.

In a modification of the above-described embodiment, the yarn guide rod 6 may be used for the simultaneous deflection of several yarns which are discharged from adjacent spinning turbines by means of their associated delivery rollers. In this case, the guide rod is provided with a corresponding number of adjacent pairs of pins 18.

Figure 2:
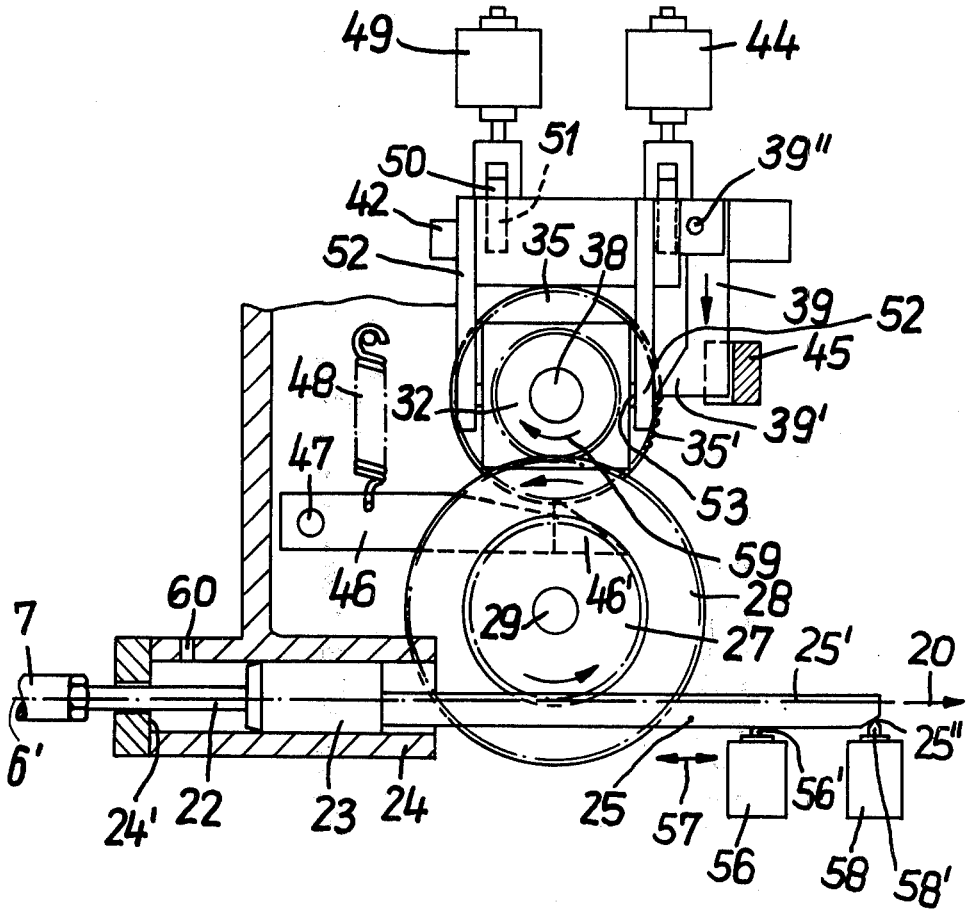
FIG. 2 is a front elevational view, partly in section, of the drive device for the yarn guide rod.
Figure 3:
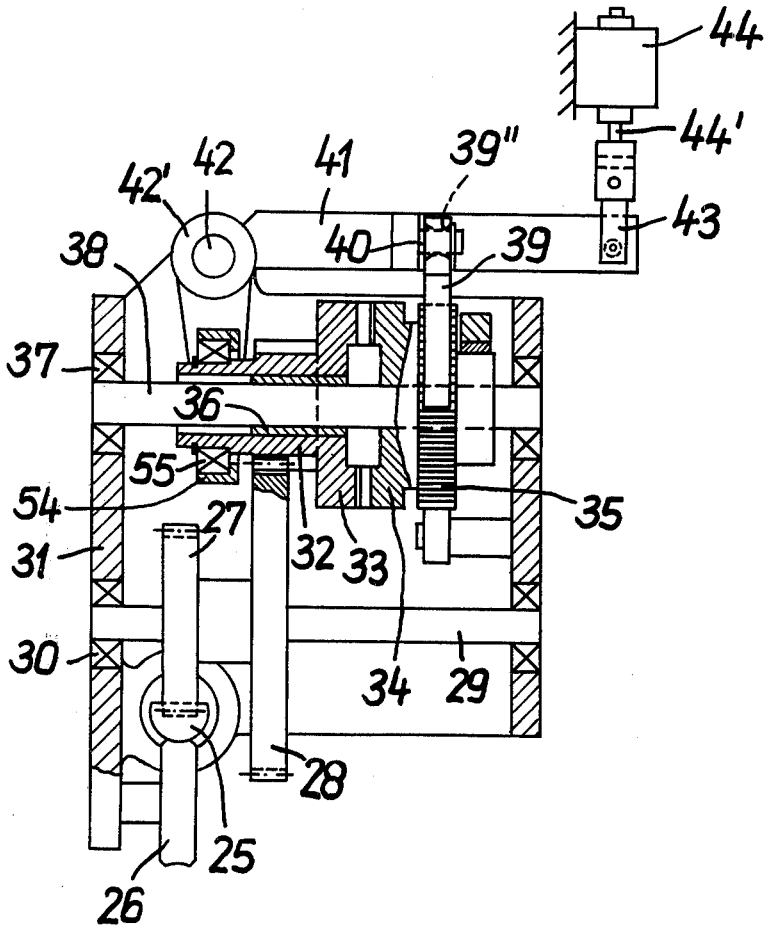
FIG. 3 is a partial sectional view of the switching gear forming the drive means.

The connector 7 of the yarn guide rod 6 is screwed to the rod 22 of an attenuation piston 23 disposed in housing 24 (FIG. 2). This piston itself is connected with a toothed rod 25 which is supported on its bottom, which is part of a circle in cross section, by a stationary guide roller 26 (FIG. 3).

The teeth 25' of the toothed rod engage in a toothed gear 27 which is attached to and rotates with a toothed gear 28 having a larger diameter. The shaft 29 carrying gears 27 and 28 is mounted in a support 31 (FIG. 3) via bearings 30. Support 31 also supports guide roller 26. The toothed gear 28 engages an axially displaceable pinion 32 provided with a coupling flange 33. This flange engages in a coupling flange 34 which is immovably mounted with respect to a ratchet wheel 35, which in turn is immovably mounted in the axial direction.

Parts 32 and 33 are supported on a shaft 38 via a slide bushing 36. Shaft 38 is held in bearings 37 and also supports the interconnected parts 34 and 35.

Ratchet wheel 35 is moved in clockwise direction by means of a pawl 39 having a toothed head 39' which engages in the teeth 35' of part 35. Pawl 39 is supported in a bore 39'' having a spherical surface on a pin 40 which is fastened to a lever 41. This lever is held in a fulcrum 42 via a welded-on bushing 42'. The freely movable end of lever 41 is connected, via a joint 43, with a spring biased electromagnet 44 which is stationarily mounted above lever 41. The spring returns the movable piston 44' of the pulling magnet into its upper end position.

One side of pawl 39 is held in a guide 45. Rotation of the ratchet wheel in the opposite direction, i.e. counterclockwise, is prevented by a blocking bar 46 serving as a flyback suppressor which is pivoted about a pivot point 47. The bar 46 has a head 46' which engages in the teeth 35' of ratchet wheel 35. Head 46' is pressed against the teeth of ratchet wheel 35 by a tensioned helical spring 48.

The coupling flange 33 is axially displaced by means of an electromagnet 49 which is connected with a lever 51, via a joint 50, and through lever 51 with a double lever 52 which is rotatably mounted on pin 42. This double lever 52 engages, by means of trunnion 53, into bushing 54 which is supported via roller bearings 55 on the extension of the displacement pinion 32. The electromagnet 49 is designed so that the parts 33 and 34, which constitute the clutch, are disengaged only when the electromagnet is switched on, i.e. when the associated coil is energized. In this case the clutch is opened by moving part 54 toward the left, i.e. by pivoting the dual lever 52 in clockwise direction.

The electromagnet 44 which drives the ratched wheel 35 is connected to be controlled by a terminal switch 56 which has a switching contact 56' actuated via control surface 25'' of toothed rod 25. Terminal switch 56 is advisably displaceable in the direction of arrows 57. The electromagnet 49 is controlled via a terminal switch 58 which is disposed behind terminal switch 56 when seen in the direction of the displacement movement indicated by arrow 20.

Figure 4:
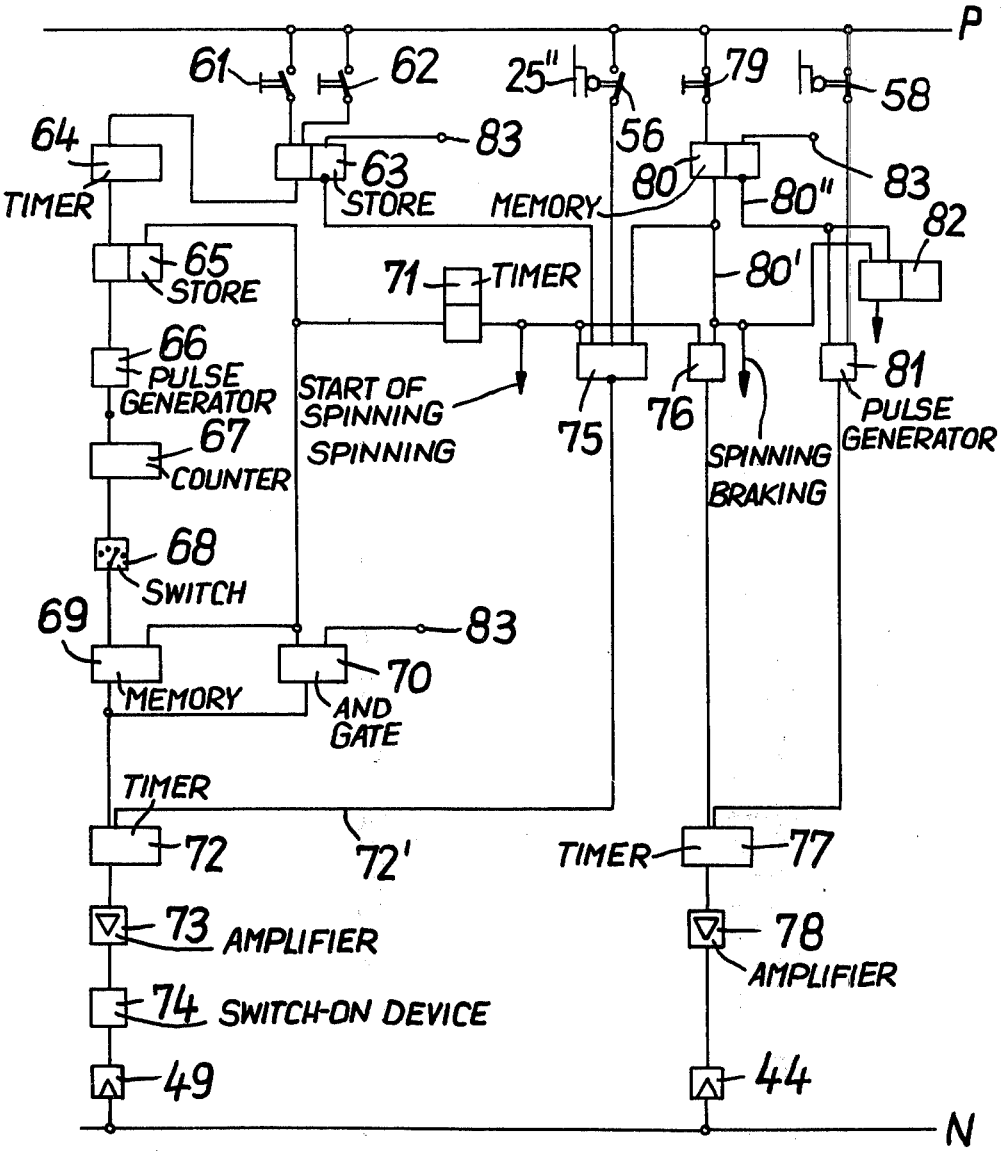
FIG. 4 is a schematic circuit diagram including the switching members required for controlling the yarn reserve formation and the back-and-forth movement.
Figure 5A:
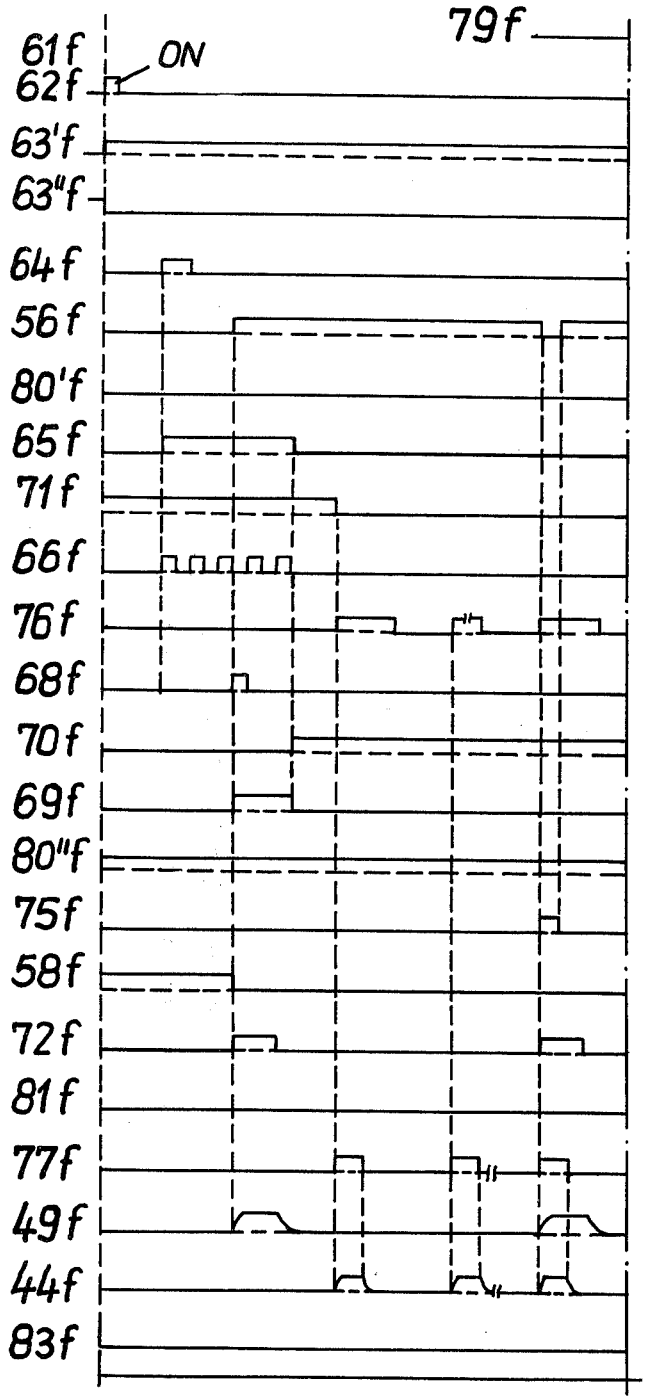
FIGS. 5*a* and 5*b* are function diagrams in which the control processes of the individual switching members (including switching on and switching off) shown in FIG. 4 are plotted over time.
Figure 5B:
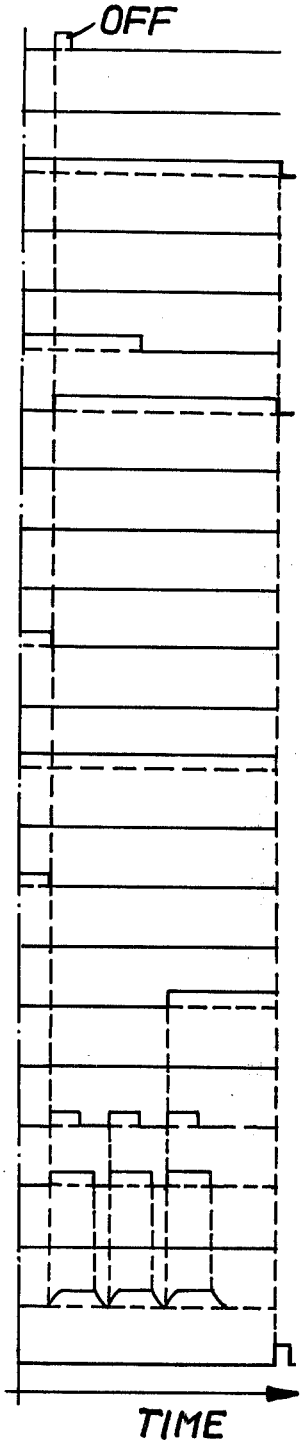

The operation of the apparatus according to the present invention will be explained in connection with FIGS. 4, *5a* and *5b*. The control operations associated with the individual switching members (FIG. 4) are shown in the function diagrams of FIGS. *5a* and *5b* with a position supplemented by the index *f*.

When the spinning machine has been switched on by the start or spinning key 61 or 62, respectively (function diagram 61*f* and 62*f*), which are part of the apparatus, an electronic store 63 (function diagram 63'*f*) is set. After a certain time—which is of no significance in this connection—timer 64 (64*f*) sets a further store 65 (65*f*) which causes a pulse generator 66 to emit a sequence of pulses 66*f* which are counted by an electronic counter 67 according to a certain code. The pulse sequence may here be produced in a known manner dependent on the path, the speed, or on time.

A preselect switch 68 interrogates a pulse 68*f* which it defines. When this certain number of pulses has been reached, a memory 69 (69*f*) is set which is erased again after further pulses by an AND gate 70 (function diagram 69*f*, 70*f*). The AND gate also erases store 65 (65*f*) and activates timer 71 which effects switching from starting-to-spin to the spinning speed of the machine (71*f*).

The setting of store 69 activates a timer 72 with fixed pulse duration 72*f*. These pulses control, via amplifier 73, a rapid switch-on device 74 which excites electromagnet 49 in about ⅛ to 1/10 of the normal setting time (49*f*), in that the coil of magnet 49—which is designed for a direct voltage of 24 volts—temporarily receives a voltage of 220 volts.

Magnet 49 thus displaces coupling flange 33 (FIG. 3) to the left until toothed gears 32, 28 and 27 are freely movable and the biased spring 15 (FIG. 1) consequently can move the yarn guide rod 6 with the yarn passing thereover into the operating position (unlatched position) over path L. This releases the yarn reserve to start spinning. The reset movement is braked by attenuation piston 23 (FIG. 2). In the vicinity of its left-hand end position, this piston covers a bore 60 in housing 24 so that a cushion of air is locked within the housing thus preventing sudden banging of piston 23 on the frontal face 24'.

After expiration of the time set by timer 71 (71*f*), the blocking of NOT-OR gate 75 (75*f*) is released so that the further unlatching of the yarn guide rod 6 by means of electromagnet 49 depends only on actuation of the terminal switch 56 (56*f*) by control surface 25'' (FIG. 2). Store 69 (69*f*) is no longer able to emit a pulse once it has been erased.

Simultaneously with switching from start-to-spin to the spinning speed, timer 71 (71*f*) cancels the block on pulse generator 76, the pulses 76*f* from which may be considerably decreased (e.g. one pulse per minute). The pulse sequence may be produced in the same manner as discussed for pulse generator 66.

With every pulse a timer 77 is activated which emits a switching pulse 77*f* of a defined duration (e.g. 0.2 seconds) to an amplifier 78. This amplifier excites pulses uniformly in pulling magnet 44 (44*f*) so that the ratched wheel 35 is switched on by one step (FIGS. 2, 3).

The movement of the ratchet wheel in the direction of arrow 59 is transmitted through the meshed coupling flanges 33 and 34, pinion 32, and toothed gears 28 and 27, so that the toothed rod 25 and the attenuation piston 23 are pulled toward the right in the direction of arrow 20 and thus also the yarn guide rod 6—in correspondence with the existing transmission ratio. Reverse rotation of the meshing parts is prevented by the lock 46.

As soon as the toothed rod 25 has moved to the right to the point where its control surface 25'' has displaced the switching contact 56' of terminal switch 56 in the direction of its longitudinal axis, the series-connected NOT-OR gate 75 emits a pulse 75*f* to the second input 72' of the timer 72 and thus again disengages the yarn guide rod 6 by exciting magnet 49 so that the back-and-forth stroke 1 is again performed. Since spring 15 is only slightly tensioned at this point, the resetting forces acting on guide rod 6 are slight. The back-and-forth movement is continued until the spinning machine has been switched off by actuation of key 79 (79*f*). This key sets memory 80 and its output 80' blocks pulse generator 76 (76*f*) for the slow pulse sequence–which was required for the back-and-forth stroke—and releases another pulse generator 81 for a fast pulse sequence 81*f* (e.g. a pulse duration of 0.5 seconds) with its output 80'' (80''*f*). At the same time store 80 blocks, with its output 80' (80'*f*), the NOT-OR gate 75 (75*f*) so that the terminal switch 56 (56*f*) becomes ineffective. The toothed rod 25 can now move rapidly beyond terminal switch 56—as a result of the fast pulse sequence 81*f* from pulse generator 81 to timer 77 which brings the duration of the pulses to the same value as during the back-and-forth stroke, and as determined by amplifier 78 and the magnet 44 controlled thereby. This occurs until the control surface 25'' shifts switching contact 58' of terminal switch 58 (58*f*). This terminal switch thus blocks pulse generator 81 (81*f*) so that magnet 44 (44*f*) is made inoperative and releases a switch-off program 82 which comprises three steps as follows: (1) reducing the speed of the spinning device to about 30% of normal working speed; (2) shutting off sliver delivery and braking down yarn winding; and (3) switching off the entire device. After this stores 63 (63''*f*), 71 and 80 are erased via a line 83 (83*f*).

The path L traversed to form the yarn reserve can be set by shifting terminal switch 58. When the machine is restarted, the yarn reserve must be released in fractions of seconds—thus the use of the very precisely operating pulse generator 66 and rapid switch-on device 74. In order for the reset movement to take place without delay, housing 24 is provided with one or more bores 60 through which the air impeding the reset movement can be expelled. The piston is braked only in the vicinity of frontal face 24' and thus sudden banging of the piston—produced as a result of the high bias of spring 15 from its greater deflection—is avoided.

It will be understood that the above description of the present invention is susceptible to various modifications, changes and adaptations and the same are intended to be comprehended within the meaning and range of equivalents of the appended claims.

What is claimed is:

1. In apparatus for forming a yarn reserve and for moving yarn back and forth in open-end spinning devices of the type having at least one spinning turbine, a yarn discharge opening, a pair of delivery rollers opposite said opening, a yarn guide rod having guide elements and disposed downstream of the opening in the direction of yarn movement, the yarn guide rod being displaceable in a direction transverse to the axis between the opening and the delivery rollers and defining deflection means for diverting the yarn from said axis, the improvement comprising means moved in only one direction of rotation for driving the yarn guide rod and in interruptable connection therewith for moving the guide rod back and forth between normal and deflected positions and for moving the guide rod to a further position for providing a yarn reserve.

2. Apparatus as defined in claim 1 wherein there is a drive gear connected to the yarn guide rod via an attenuation device, a stepping mechanism for moving said drive gear in the direction of yarn deflection, a resetting device which is connected with the yarn guide rod and against the action of which the stepping mechanism moves, a clutch connected in the driving means between the stepping mechanism and the drive gear and which is released to permit the resetting device to act, switching units to which the drive of the stepping mechanism and the displacement device for the clutch are connected, the switching units being switched on at a preselectable position of the yarn guide rod with respect to the axis in order to actuate the stepping mechanism or disengage the clutch, respectively.

3. Apparatus as defined in claim 2 including a toothed rod and wherein the yarn guide rod is connected via the toothed rod, with a reduction gear pair of toothed wheels having pinions which are part of the clutch.

4. Apparatus as defined in claim 3 including a lever and a spring-biased magnet and wherein the stepping mechanism includes a pawl engaging in the teeth of a ratchet wheel, the pawl being displaceable under the influence of the lever and by means of the spring-biased magnet in a direction perpendicular to the axis of rotation of the ratchet wheel, said ratchet wheel being provided with a flyback suppressor which prevents rotation counter to the movement of the pawl.

5. Apparatus as defined in claim 4 wherein the toothed rod coacts with the switching units which are terminal switches associated with the magnet and the displacement device, means mounting the magnet terminal switch for adjustment of the position thereof with respect to the control surface of the toothed rod and disposed in front of the terminal switch for the displacement device when viewed in the direction of the displacement produced by the stepping mechanism.

6. Apparatus as defined in claim 5 wherein the attenuation device includes a piston which is supported during the resetting movement of the yarn guide rod in the region of the normal position of the guide rod, by a cushion of air.

7. Apparatus as defined in claim 6 including a stationary guide roller and a flexible tensioning element and wherein the resetting device includes a biased spring the longitudinal axis of which is offset by 90° with respect to that of the guide rod and which is connected, via said stationary guide roller and said flexible tensioning element, with the guide rod.

8. Apparatus as defined in claim 7 including an electromagnet and a rapid switching device, wherein the clutch has a movable component which is connected with the electromagnet which can be suddenly excited to release the yarn reserve by disengaging the clutch, by means of the rapid switching device.

9. Apparatus as defined in claim 8 including a counter and wherein the switching time of the rapid switching device is controlled by said counter with preselectable running time, said counter being coupled to the switch-on device for the spinning machine.

10. Apparatus as defined in claim 9 wherein the counter includes an electronic pulse counter which is connected in series with a speed, path or time controlled pulse generator.

11. Apparatus as defined in claim 5 wherein the magnet terminal switch is coupled to a blocking switch for the start-to-spin phase and to a blocking switch for the switch-off phase.

12. Apparatus as defined in claim 4 including a pulse generator and wherein the magnet for the back-and-forth stroke and for the reserve stroke is excited during the spinning phase by the pulse generator with low pulse repetition rate and during the switch-off phase by said pulse generator with a higher pulse repetition rate.

13. Apparatus as defined in claim 12 wherein a timer with a set pulse duration is connected to control the electromagnet.

14. Apparatus as defined in claim 1 wherein said means for driving includes means for moving the guide rod to a further position for providing a yarn reserve.

15. Apparatus as defined in claim 1 wherein said means for driving includes only a single source of driving power.

* * * * *